United States Patent [19]

O'Ffill

[11] 4,088,562

[45] May 9, 1978

[54] METHOD AND APPARATUS FOR PROCESSING OIL SHALE

[75] Inventor: Joseph M. O'Ffill, Shawnee Mission, Kans.

[73] Assignee: Twenty Farms, Inc., Kansas City, Mo.

[21] Appl. No.: 803,266

[22] Filed: Jun. 3, 1977

Related U.S. Application Data

[63] Continuation-in-part of Ser. No. 633,541, Nov. 19, 1975, abandoned.

[51] Int. Cl.[2] ..... C10G 1/02

[52] U.S. Cl. ..... 208/11 R; 201/29; 201/38

[58] Field of Search ..... 208/11 R; 201/36, 38, 201/29, 30, 43

[56] References Cited

U.S. PATENT DOCUMENTS

| | | | |
|---|---|---|---|
| 1,323,681 | 12/1919 | Day | 208/11 R |
| 1,336,264 | 4/1920 | Turner | 201/35 |
| 1,563,271 | 11/1925 | Fogh | 208/11 R |
| 2,705,697 | 4/1955 | Royster | 208/11 R |
| 3,487,004 | 12/1969 | Berry | 208/11 R |
| 3,556,979 | 1/1971 | Needham | 208/11 R |
| 3,573,194 | 3/1971 | Hopper et al. | 208/11 R |
| 3,617,467 | 11/1971 | Reyburn et al. | 208/11 R |
| 3,887,453 | 6/1975 | Neta et al. | 208/11 R |
| 3,960,702 | 6/1976 | Allred | 208/11 R |

*Primary Examiner*—Delbert E. Gantz
*Assistant Examiner*—James W. Hellwege
*Attorney, Agent, or Firm*—Schmidt, Johnson, Hovey & Williams

[57] ABSTRACT

A low cost, high efficiency process for treating oil shale is provided which allows essentially complete recovery of the valuable hydrocarbon fraction of the shale, including light ends, without direct firing of the shale or use of other expensive processing steps heretofore proposed. In preferred forms, the oil shale is heated in a closed heating system using circulating, oxygen-free gases until the shale "break point," or temperature at which the hydrocarbons begin to vaporize from the shale, is reached; at this point the system is slowly depressurized and hydrocarbons are simultaneously released to a condensation stage for the recovery thereof and control of circulating fan horsepower. Steam may also be added to the circulating system to further purge hydrocarbons from the shale and provide additional control of fan horsepower.

9 Claims, 2 Drawing Figures

METHOD AND APPARATUS FOR PROCESSING OIL SHALE

Figure 1:
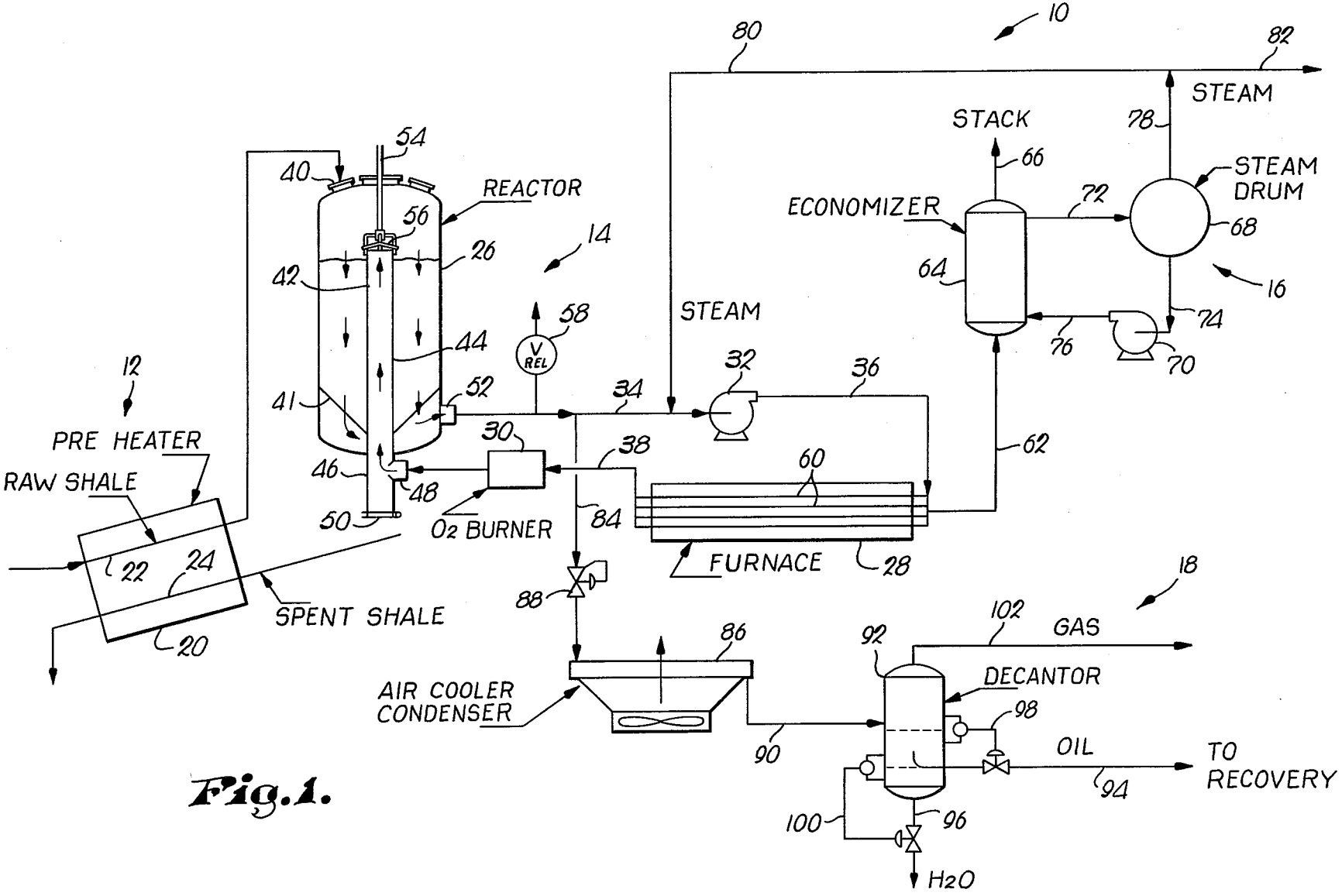

This application is a continuation-in-part of application Ser. No. 633,541, filed Nov. 19, 1975, and entitled METHOD AND APPARATUS FOR PROCESSING OIL SHALE and now abandoned.

As virtually every motorist and homeowner around the world well knows, the cost of natural gas and petroleum products has risen sharply in recent years. While the absolute supply of hydrocarbons in the world is very large, the world is nevertheless running short of petroleum and gas reserves which can be extracted at relatively low cost. For example, it is known that in the western part of the United States vast deposits of oil shale are present which contain significant quantities of hydrocarbons (known as kerogen). However, prior attempts at extracting oil and other products from oil shale have met with very little success, primarily by virtue of the cost attendant to recovering the oil. Thus, if relatively inexpensive extraction techniques could be developed for the processing of oil shale, a significant step could be made toward at least partially alleviating the present energy crisis.

Prior methods of processing oil shale have generally involved retorting the shale to a temperature sufficient to drive off and volatilize the hydrocarbon content thereof. In this connection, a wide variety of such processes have been proposed in the past, but as noted, none have achieved the economies necessary for widespread use. Exemplary recovery processes and background information are contained in the following: U.S. Pat. Nos. 1,563,271, 1,833,155, 2,705,697, 3,074,877, 3,090,731, 3,480,082, 3,487,004, 3,573,194, 3,617,467, 3,784,462, 3,177,128, 1,875,249, 1,929,408, 1,704,094, 873,647, 2,757,129, 3,051,629, 3,375,175, 3,409,509, 3,617,466, 3,756,922, 3,855,071, and 3,887,453; and in an article entitled "The Production of Shale Oil", appearing in the October, 1973 issue of "Chemtech" magazine, in a scientific abstract entitled "Fischer Assay of Oil Shale Procedures of the Oil Shale Corporation" by Lawrence Goodfellow and Mark T. Atwood, and in a brochure schematically illustrating and briefly describing "The Paraho Process" in various issues of the magazine "Shale Country", and in the book entitled "Synthetic Fuels Data Handbook".

It is therefore the most important object of the present invention to provide an improved method for treating oil shale in order to remove essentially all of the valuable hydrocarbons therefrom, and at a cost which is competitive, or nearly so, with traditional sources of petroleum products and the like.

As a corollary to the foregoing, another object of the invention is to provide a method of treating oil shale wherein a quantity of the latter is heated in a closed heating system, using a circulating, essentially oxygen-free gas so as to heat the shale at least until the "break point" thereof is reached, at which time hydrocarbons begin to vaporize from the shale; at this point the system is opened and the gaseous hydrocarbons are sent to a recovery stage which generally would include means for condensing the heavier hydrocarbons and collecting the noncondensible gases. A prime advantage of the method stems from the fact that a sidestream of hydrocarbons is drawn off from the recycle stream for condensation, thereby eliminating the costly (in terms of energy use) practice of cyclically passing the entire recycle stream through condenser means. Preferably, air which has been treated to remove the oxygen therefrom is used as the circulating heating gas, and such air is cyclically heated in an indirect manner and sequentially passed downwardly through a substantially stationary pile of ground oil shale.

Another aim of the invention is to provide an improved process of the type described which further includes the preferred step of adding steam to the system at or near the time the so-called "break point" is reached, so as to in effect lower the average molecular weight of the gas within the heating system (in order to preclude the possibility of overloading the circulating fan apparatus provided with the heating system), with steam addition and additional heating being continued during the condensation and recovery stage of the process so that the pile is heated to the temperature necessary to assure complete liberation of all valuable hydrocarbon gases therefrom. In practice, the amount of steam addition serves to control the quantity of gas recovered from the process so as to give a high degree of operational flexibility to the latter.

Figure 2:
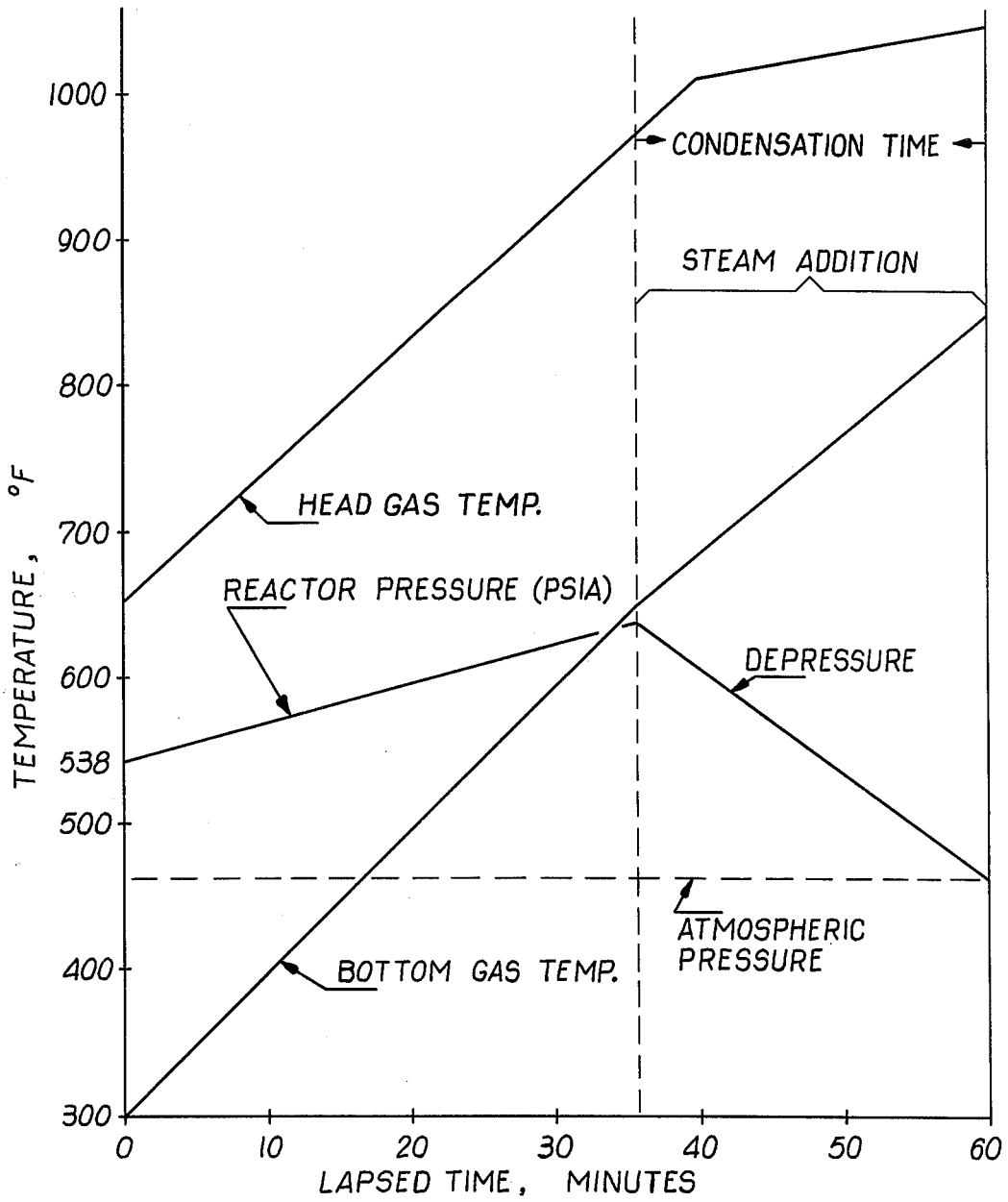

In the drawings:

FIG. 1 is a schematic representation of production-scale equipment to be used in processing shale oil or other oilcontaining solid materials; and FIG. 2 is a graphical representation which illustrates important process parameters during one preferred process of the present invention wherein oil shale is treated.

Turning now to the drawings, overall processing apparatus 10 preferably used in following the method hereof is schematically illustrated in FIG. 1. Briefly, apparatus 10 includes a preheater stage 12, along with a material heating system 14 which can be closed to the atmosphere, steam recovery apparatus 16, and condensation and product recovery stage 18. As will be explained, apparatus 10 is useful for treating a charge of raw oil shale or other oil-containing solid material in order to extract therefrom virtually all of the recoverable hydrocarbons therein at relatively low cost in terms of required energy input.

In more detail, preheater stage 12 preferably includes an elongated, conventional tunnel-type heat exchanger 20 which is schematically illustrated in FIG. 1. As is usual with equipment of this type, a pair of countermoving conveyors 22 and 24 are provided within exchanger 20. In practice, hot, spent oil shale is passed through exchanger 20 on conveyor 24, while a charge of raw, unheated shale is passed countercurrently thereto on conveyer 22, so that the raw shale is initially heated.

Heating system 14 includes a shale-receiving reactor 26, along with a conventional furnace 28, oxygen burner 30 and circulating fan apparatus 32. In addition, a line 34 extends between the outlet of reactor 26 and the inlet side of fan apparatus 32, while a line 36 extends from the outlet of the latter to the inlet of furnace 28. Finally, a line 38 extends between the outlet of furnace 26 and the gas inlet for reactor 26, and has oxygen burner 30 interposed therein.

Reaction vessel 26 is of closed, generally cylindrical configuration and is preferably formed of steel. Appropriate, sealable shale inlet means 40 is provided in the top wall of the reactor 26 for the purpose of allowing a charge of ground oil shale to be deposited within the vessel. The interior of reactor 26 includes a cone shaped screen 41 which is adapted to support a charge of oil shale, along with a tubular, vertically reciprocable riser 44 centrally disposed within the vessel. Riser 44 is telescopically interfitted with a lower pipe section 46 which includes a gas inlet 48. The bottom of pipe 46 is normally closed by means of a cover 50. It will also be seen that the gas outlet 52 associated with reactor 26 is disposed below the screen 42, and this location is important for purposes to be made clear. Operating mechanism 54 is coupled to the upper end of riser 44 in order to shift the latter vertically as desired for shale unloading purposes. Mechanism 54 also includes a baffle 56 located directly above the open end of riser 44 for downward diversion of the gases passing upwardly through the riser.

A conventional, pressure-sensitive relief valve 58 is interposed within line 34 between gas outlet 52 and fan apparatus 32. The purpose of valve 58 is to relieve the pressure within heating system 14, should the pressure therein rise to a dangerous level.

Furnace 28 is likewise of essentially conventional construction and includes a plurality of gas-receiving, tubular, indirect heating pipes 60 therewithin. These pipes 60 communicate with line 38 as will be readily apparent. Although not shown, the furnace 28 also includes the usual fuel inlet and associated structure.

Finally, oxygen burner 30 is of known construction and is operable for removing the oxygen content in the gases circulating within the heating system 14 during initial stages of the process.

Steam recovery apparatus 16 includes a line 62 leading from the heating pipes 60. A conventional economizer 64 is operably connected to the remaining end of line 62, and has the usual stack line 66 coupled thereto. A steam drum 68 is also provided, along with a circulating fan 70, and appropriate lines 72, 74 and 76 located between the economizer, drum 68 and fan 70. The steam outlet line 78 is also coupled to drum 68, and to a process steam line 80. As shown, the latter is connected to line 34 adjacent the inlet to fan apparatus 32. In addition, a leg 82 is also provided for delivery of excess steam to a boiler or other utility for use in the overall processing plant.

Product condensation and recovery stage 18 includes a sidestream line 84 which is connected between line 34 and air cooled condenser apparatus 86. A pressure sensitive valve 88 is interposed within line 84 for selective opening and closing of the latter. As will be readily appreciated, condenser apparatus 86 is of conventional construction, and may include one or more separate serially interconnected condensers.

An outlet line 90 extends between condenser apparatus 86 and conventional decanter structure 92. The latter is adapted for separating the oil and water received from condenser apparatus 86, and for this purpose includes an oil recovery line 94, a bottoms line 96 for waste water, and appropriate recycle means 98 and 100. Finally, a gas recovery line 102 is connected to the upper part of decanter structure 92 for the purpose of conveying noncondensible hydrocarbon gases for recovery and use. In this connection, such gas can be used in furnace 28, or for other utility purposes as will be readily appreciated.

It is also significant that stage 18 is in parallel, rather than in series with, material heating system 14. Thus, during the product recovery cycle described below, a sidestream of hydrocarbon gases may be passed through stage 18 for recovery without the necessity of passing the entire recycle stream within system 14 therethrough.

The process of the present invention is preferably carried out in the following manner:

First, a charge of raw shale is passed in the countercurrent relationship to a charge of hot, spent shale within heat exchanger 20. This has the effect of initially preheating the raw shale to a temperature within the range of from about 500°–600° F. The preheated shale is then passed into reaction vessel 26, and the latter is sealed, and valves 58 and 88 closed. In effect, a closed heating system is thus defined by the reactor 26, furnace 28, and lines 34, 36 and 38. However, the residual gases within the closed heating system are normally at an elevated temperature of, for example, 300° F., because of the treatment of prior batches of shale therewithin. At this point fan apparatus 32 is started, along with oxygen burner 30. This has the effect of circulating the air and gases within the closed heating system. From the outlet of the furnace 28, these gases pass through line 38 and oxygen burner 30, and into gas inlet 48. The gases then rise through riser 42 whereupon they are deflected by baffle 56 and travel downwardly through the interstices of the stationary pile within the reactor. This downward flow of the gases is illustrated by the arrows in FIG. 1. The gases pass through the screen 41 supporting the pile, and thence out of reactor 26 through the outlet 52. The gases then pass through line 34, fan apparatus 32 and line 36, whereupon they are returned to furnace 28. In the latter connection, the gases pass through the pipes 60 disposed within the furnace 28, so that the gases are indirectly heated during their travel through the furnace.

This heating continues until substantially all of the oxygen within the heating system is eliminated. This condition is monitored by conventional oxygen sensors, as will be readily understood by those skilled in the art. In any event, when the essentially oxygen-free condition is reached, burner 30 is shut down, whereupon the oxygen-free gases (primarily nitrogen) are continually circulated through the heating system in the manner described. This has the effect of continuing the heating of the pile of shale within the reactor 26.

Heating with $O_2$-free gases continues until the temperature of the gases leaving reactor 26 reaches the so-called "break point" for the shale being treated. This is the temperature at which hydrocarbons begin to volatilize from the shale. At this "break point" relatively heavy hydrocarbons in vapor form begin to circulate through heating system 14; these relatively heavy gases can, under certain conditions, overload fan apparatus 32. Accordingly, in order to lower the actual average density of the gases in system 14, the system may be depressurized to lower the density and/or steam may be added thereto for the same purpose through line 80, just ahead of the inlet of fan apparatus 32. Steam may also be added near the end of the process and thus purge the system and prevent coking thereof.

In addition to the foregoing, when depressurizing at the time the "break point" is reached, valve 88 may be opened to depressurize the system 14 so so that a sidestream of the recoverable hydrocarbons within the system 14 can be condensed or otherwise collected. In the embodiment illustrated in FIG. 1, air-cooled condensing means 86 are employed for condensing at least a fraction of the hydrocarbons. The output from condenser 86 (which would normally contain both liquids and noncondensible gases) is fed via line 90 to decanter structure 92. This unit is, in the known fashion, capable of separating the oil and water from condenser 86, in order to give a recovered oil product out line 94, and waste water out line 96. In addition, noncondensible hydrocarbon gases are passed as overhead through line 102 for recovery or further use.

During the described condensation-recovery process, heating of the pile is continued by means of gas circulation in the manner noted. This heating continues until the pile temperature reaches that necessary to ensure complete volatilization of the recoverable hydrocarbons. For many shales, this temperature is about 850° F. Preferably, the equipment employed is sized such that this final pile temperature is reached at about the time the condensation cycle is at or near completion.

A prime advantage of the present invention stems from the fact that the recycling heating gases within system 14 are not passed through the condensation and recovery stage 18; rather, as noted, a sidestream is drawn off from the system 14 via line 84 for recovery. This has a number of desirable effects. First, since the heating, $O_2$-free gases are not cooled during each cycle thereof, it takes less energy to raise these gases, and thus the shale pile, to the final temperature necessary for complete product recovery. This is to be contrasted with the conventional approach where the recycle gases are serially passed through a condensation stage; as can be appreciated, such a procedure makes it necessary to reheat the heating gases after each passage through the condenser means, and this in turn greatly increases the energy input to the process. In addition, sequential cooling and reheating of the recycle gases makes it completely uneconomical to recover the light ends from the shale, since this would require cyclic cooling of the recycle heating gases to a level where reheating thereof after condensation and recovery of the light ends therefrom would be prohibitively expensive. Thus, with the usual approach, valuable light ends are simply not recovered as a condensate. However, in the present invention all light ends are recovered, along with the heavier fractions.

It will also be recognized that during heating of the shale prior to the condensation and recovery steps, the pressure within system 14 is continually rising. Preferably, the pressure should not be allowed to rise above about 15 p.s.i.g., and for this purpose pressure sensitive valve 58 is provided for relief of the system as necessary. However, upon opening of valving 88, the heating system 14 begins to depressurize, and, at the end of the condensation-recovery cycle, the pressure within system 14 is essentially atmospheric.

It has also been discovered that steam addition after the "break point" has been reached can alter the amount of gas recovered from the process, and correspondingly lower the quantity of recovered condensate. Thus, if in a given plant greater quantities of gas are needed or desired for fuel purposes, it is only necessary to add greater quantities of steam to the process during the condensation and recovery stage. Therefore, steam addition can serve a number of different purposes in the process hereof, i.e., molecular weight control of the recycle gases, system purging and cleaning, and alteration of the character of the end products as desired.

During the above-described process, steam generated within system 14 by virtue of heating of the shale is drawn off and recovered in apparatus 16. This steam is generated by virtue of liberation of the native water within the shale, and through recovery of injected steam. As noted above, this apparatus is essentially conventional. Moreover, the quantity of steam recovered during the process is in many cases in excess of that needed for injection purposes as described. Thus, a considerable quantity of excess steam can be directed via leg line 82 for power generation or other uses within the overall processing plant.

It is to be understood that the foregoing discussions regarding steam addition comprehend addition of steam and/or water (which is of course converted to steam within the heating system), and these alternatives are deemed equivalent for purposes of the invention.

The following examples will illustrate the present method, but nothing therein is to be taken as a limitation upon the scope of the invention.

EXAMPLE I

A pilot plant run in accordance with the present invention was conducted using two tons of so-called "Mahogany" oil shale. This raw shale was determined by Fischer assay to have about 34.5 gallons per ton of oil recoverable as a liquid therein (26.1 A.P.I. gravity), and a predicted recoverable gas content of about 935 standard cubic feet per ton (1202 B.T.U./ cubic foot).

The oil shale was ground approximately to the size of chat and placed in a reaction vessel of the type illustrated in FIG. 1. The temperature of the shale pile at start-up was 69° F., and the stationary pile was about 8 feet in depth in the reactor. The condensing system in this case comprised three serially interconnected, water cooled condensers, and the outlet from the final condenser was ½ inch in diameter by virtue of the size and capacity of the condensers and necessity of restricting gas flow thereto at a level in accordance with condensation capacity. The process furnace was then started using municipal gas as a fuel. Firing of the furnace continued for a period of about 20 to 30 minutes without air or gas circulation, in order to fully heat the furnace refractory and associated equipment.

At this point the oxygen burner was started, and circulation of air through the furnace and pile was commenced by starting the furnace blower. At start-up of the oxygen burner, the head gas above the pile was at a temperature of about 90° F. Operation of the oxygen burner continued for a period of about ten minutes, until system oxygen level meters indicated that the air within the closed system contained less than 1% oxygen. The gas above the pile at this point was 580° F.

The circulating fan system was then turned on to full performance, thus causing cyclical circulation of substantially oxygen-free gases downwardly through the interstices of the pile in order to heat the same, with the gases passing through and heating the pile being sequentially indirectly reheated during passage through the furnace. This cycling continued for a period of about 1 hour and 20 minutes, and the temperatures recorded during this span are set forth in Table I. Probe No. 1 measured head gas temperature above the pile; probes Nos. 2, 3 and 4 measured pile temperature at 2 foot intervals; and probe No. 5 measured bottom gas temperature:

TABLE I[1]

| Probe No. | 0 | 10 Min. | 20 Min. | 30 Min. | 40[2] Min. | 50 Min. | 60 Min. | 70 Min. | 80 Min. | 90[3] Min. | 100 Min. | 110 Min. |
|---|---|---|---|---|---|---|---|---|---|---|---|---|
| | | TIME | | | | | | | | | | |
| No. 1 | 580 | 600 | 760 | 807 | 869 | 938 | 961 | 991 | 1004 | 987 | 972 | 842 |
| No. 2 | 107 | 571 | 612 | 752 | 803 | 914 | 950 | 975 | 989 | 1003 | 985 | 976 |
| No. 3 | 84 | 192 | 227 | 554 | 669 | 776 | 919 | 929 | 934 | 943 | 955 | 959 |
| No. 4 | 69 | 190 | 223 | 333 | 625 | 714 | 894 | 909 | 919 | 923 | 928 | 930 |
| No. 5 | — | — | — | — | 535 | 695 | 899 | 917 | 913 | 920 | 928 | 930 |

[1]All temperatures given in ° F.

[2]Recovery stage begun by opening valve to condensers and drawing off sidestream from closed heating system; condensate drawn off from condensers at ten-minute intervals until end of run; non-condensibles passing through condensers flared.

[3]Furnace turned off at this point and steam added to system; circulation fan continued in operation.

As can be seen from the foregoing table, the oil shale pile was gradually heated as the hot oxygen-free air was cycled therethrough. It is known that heating of the test shale to about 850° F. serves to liberate essentially all of the recoverable hydrocarbons therefrom, and thus heating of the shale to at least this level was needed. However, the so-called "break point" where hydrocarbons begin to volatilize is about 650° F. After about 40 minutes of heating, the "break point" was reached and the outlet pipe from the reaction vessel was opened. This was done in order to draw off a sidestream from the heating system (without cyclic condensation of the heating gases themselves) and to commence the condensation cycle and prevent the buildup of pressures within the system to levels which the pilot plant equipment could not safely tolerate. However, the ½ inch outlet pipe from the condensers, and the small condenser capacity, meant that a relatively long time was needed for complete condensation, i.e., about 70 minutes.

After about 90 minutes into the run, water was injected into the system and converted to steam in order to lower the average molecular weight of the gases and to keep system pressure at a level of about 6 p.s.i.g. This steam also served to increase the quantity of gas recovered and as a final purge of the system, ensuring complete recovery of product. In addition, the steam was effective for cleaning the system and preventing coking thereof. The total quantity of water within the system from injection and native water in the shale, was calculated to be about 1.3 gallons, and this was of course converted to steam in the system for the purposes noted.

During the condensation stage, liquid oil product was periodically drawn off and collected at 10 minute intervals. Also, the noncondensible gases were sampled at intervals throughout the condensation period so as to determine qualitatively their content.

At the end of 110 minutes the entire pilot plant apparatus was shut down. The results of this run in terms of recovered products is set forth below:

TABLE II

CONDENSATES [1]

| Product | % by Weight | Specific Gravity | ° API |
|---|---|---|---|
| Light Gasoline | 6.5 | 0.733 | 61.6 |
| Total Gasoline, Naptha | 31.7 | 0.796 | 46.3 |
| Gas Oil | 26.7 | 0.894 | 26.7 |
| Nonviscous lub. dist. | 11.1 | 0.926 – 0.949 | 21.2 – 17.7 |
| Medium lub. dist. | 5.9 | 0.949 – 0.966 | 17.7 – 15.1 |
| Viscous lub. dist. | 12.4 | 0.966 – 0.998 | 15.1 – 10.3 |
| Residium | 12.5 | 1.032 | 5.6 |

TABLE II-continued

CONDENSATES [1]

| Product | % by Weight | Specific Gravity | ° API |
|---|---|---|---|
| Distillation Loss | .4 | — | — |

[1]Total condensate recovered about 34 gal./ton of shale; condensates had a specific gravity of 0.895, ° API of 26.1, pour point of 44° F., sulfur content of 0.65%, nitrogen content of 1.989%, and Saybolt Universal Viscosity at 77° F., 44 sec., and at 100° F., 42 sec.

TABLE III

GAS ANALYSIS [1]

| Product | Mole % ($CO_2$ - free) |
|---|---|
| $H_2$ | 27.0 |
| $O_2$ | 0.3 |
| $N_2$ | 1.5 |
| CO | 2.8 |
| $C_1$ | 32.3 |
| $C_2$ | 24.9 |
| $C_3$ | 6.4 |
| $C_4$ | 2.8 |
| $C_5$ | 0.8 |
| $C_6$ | 0.4 |
| $C_7$ | 0.4 |
| $C_8$ and above | 0.4 |

[1]1350 S.C.F. of gas recovered per ton of shale.

A review of the above results will demonstrate that recovery of product met or exceeded the predicted values. In the case of gas recovery, the relatively high figure of 1350 S.C.F./ton is believed to stem from the addition of water to the system as described. On a calculated basis, about 0.5 gallons of recoverable liquid condensate reacted with the 1.3 gallons of water within the system to give the gas increase. It will thus be appreciated that the extent of gas production can be raised, with condensate recovery being correspondingly lowered, by the addition of water and/or steam to the system. It is also apparent that the light ends and other valuable low-boiling constituents of the shale were recovered using the process hereof.

In another test very similar to that outlined above, the same type of shale was treated in the described pilot plant apparatus. In this case however, no water or steam was added during the run. The condensates recovered from this run were analyzed to include the following:

TABLE IV

CONDENSATES [1]

| Product | % by Weight | Specific Gravity | ° API |
|---|---|---|---|
| Light Gasoline | 3.1 | 0.743 | 59.0 |
| Total Gasoline Naptha | 20.2 | 0.788 | 48.0 |
| Gas Oil | 24.0 | 0.874 | 30.4 |

TABLE IV-continued

| CONDENSATES [1] | | | |
|---|---|---|---|
| Product | % by Weight | Specific Gravity | ° API |
| Nonviscous lub. dist. | 12.2 | 0.908 - 0.934 | 24.3 - 20.0 |
| Medium lub. dist. | 6.6 | 0.934 - 0.955 | 20.0 - 16.7 |
| Viscous lub. dist. | 15.8 | 0.955 - 0.979 | 16.7 - 13.1 |
| Residium | 21.0 | 0.999 | 10.1 |
| Distillation Loss | 0.2 | — | — |

[1]Condensates had a specific gravity of 0.908, ° API 24.3, pour point of 70° F., sulfur content of 0.70, nitrogen content of 1.856, and Saybolt Universal Viscosity at 77° F., 66 sec., and at 100° F., 52 sec.

The results given in Table IV demonstrate that less light ends and gasoline were recovered, as compared with the results of Table II. This is believed attributable to the absence of added water in this test run. Thus, water addition is seen to cause a shift in the type of products recovered from the heavier hydrocarbons to the lighter varieties.

EXAMPLE II

Large-scale apparatus of the type depicted in FIG. 1 is used to treat a sixty ton charge of ground oil shale. This shale is initially at a temperature of about 77° F., and should theoretically be heated to a level of 855° F. to liberate all of the recoverable hydrocarbon products therefrom as vapors.

The sixty ton charge of raw shale is first passed through a preheater consisting of a conventional, elongated, tunnel-type heat exchanger. The hot (about 891° F.) spent shale from a previous run (48.84 tons) is likewise passed through the exchanger in countercurrent relationship to the incoming raw shale so as to preheat the latter to a temperature of about 538° F.

The preheated shale is next passed into a reaction vessel where it is supported as a stationary pile. The residual gas from the previous run within the normally closed heating system is about 300° F.

At this point the furnace, circulating fan and $O_2$ burner are started, for cycling of the air and gases within the closed heating system. The $O_2$ burner is kept in operation until the $O_2$ level in the heating system is below about 1%. The furnace continues cyclically heating the $O_2$-free gases, however, until the bottom gases from the reactor reach a temperature of about 850° F. thus assuring complete volatilization of recoverable products. In the illustrated apparatus this takes a period of about 60 minutes. During the heating cycle the maximum system pressure is held to 14.0 p.s.i.g., and a maximum furnace outlet temperature of 1100° F.

After the appropriate time of furnace operation (i.e., about 36 minutes), the bottoms gas in the shale reactor reaches 650° F., thus indicating that all of the shale is at least this temperature. This in turn signifies that the "break point" has been reached when hydrocarbon gases begin to volatilize from the shale. Steam from the steam drum is then added ahead of the fan inlet in order to control the average molecular weight of the gases in the heating system. In this connection, the volatilized hydrocarbons are assumed to have an average molecular weight of about 69, and these heavy gases, unless lightened, can overload the circulation fan (the average molecular weight of the system gases prior to commencement of liberation of hydrocarbons from the pile is assumed to be about 30). During the remainder of the cycle time (24 minutes), steam is continually injected into the system ahead of the fan inlet. The total amount of steam injected is about 2,673 lbs.

In addition to steam addition at the "break-point" of 650° F., a sidestream is drawn off from the previously closed heating system to begin the condensation cycle, which takes about 24 minutes. The air cooled condensors have a total duty of 37,880,450 BTU/hr. in order to condense the condensible hydrocarbons within this time period. Heating of the pile also continues during the condensation period such that at the end of the run (about 60 minutes), the bottom gas from the reactor is somewhat above 850° F., indicating that all hydrocarbons from the shale have been recovered. At the end of the 60 minute process time, all hydrocarbons have been recovered, and the spent shale is ready for disposal (after being used to preheat the next incoming batch of raw shale). It is noted that the continued heating of the pile during the condensation cycle does not involve successive cooling of the cycling heating gases, since the condensation stage is parallel, and not in series with, the heating system.

The important parameters of this production scale run are graphically illustrated in FIG. 2. That is to say, during the 60 minute run the gas temperatures continually increase until head gas is at about 1050° F. and bottom gas is at about 850° F. (The average temperature of the pile is thus about 891° F.) During the initial 36 minutes of processing, system pressure likewise increases up to a maximum of about 14 p.s.i.g. At the "break point", steam is added to the system and condensation causes depressurization back to essentially atmospheric over the 24 minute condensation time.

The above described process recovers about 15,120 lbs. of liquid oil, 4,260 lbs. of gas, and 7,150 lbs. of steam (of which 2,673 lbs. were used in the process, leaving 4,477 lbs. for other uses).

Having thus described the invention, what is claimed as new and desired to be secured by Letters Patent is:

1. A batch method of processing oil shale or other similar solid material containing recoverable hydrocarbons, comprising the steps of:

placing a batch of said oil shale within a heating system which is closed to the entrance of atmospheric air, said system including a furnace for indirect heating of gases;

holding said batch of oil shale stationary within said system;

initially heating said stationary batch of oil shale until a substantial quantity of hydrocarbons begin to vaporize therefrom while maintaining said system in said closed condition such that the pressure within said system increases during said initial heating, said initial heating including the steps of, cyclically, (1) heating a substantially oxygen-free gas in said furnace;

(2) passing the heated gas through said oil shale for heating thereof; and (3) passing said gas directly back to said furnace from said shale batch, said direct passage occurring in a manner to preclude substantial cooling of said gas and separation of materials therefrom;

further heating the stationary batch of oil shale after said substantial quantity of hydrocarbons has begun to vaporize therefrom and admix with said gas, and recovering said vaporized hydrocarbons, said further heating and hydrocarbon recovery step including the steps of maintaining said system closed to the entrance of atmospheric air, and—

(1) continuing the heating of said oil shale batch by, cyclically,—

(a) heating said substantially oxygen-free gas and at least a portion of the vaporized hydrocarbons admixed therewith in said furnace;

(b) passing the heated gas and vaporized hydrocarbons through said oil shale for heating of the latter; and (c) passing said gas vaporized hydrocarbons directly back to said furnace for additional heating thereof, said direct passage occurring in a manner to preclude separation of hydrocarbons from said gas in said heating system, by cooling of the gas and vaporized hydrocarbons sufficient to cause condensation of the vaporized hydrocarbons within the heating system; and (2) during said continued heating of the oil shale, opening said system and passing a portion of said gas and volatilized hydrocarbons out of said heating system and into a recovery stage which is separate from said heating system in order to allow recovery of said vaporized hydrocarbons and to lessen the extent of any pressure increase within said system, and recovering said vaporized hydrocarbons therein.

2. The method as set forth in claim 1 wherein said heating system includes a shale-receiving reaction vessel, a furnace, and conduit means interconnecting said furnace and vessel for circulating passage of the gas from said furnace, through said vessel and shale, and back to said furnace.

3. The method as set forth in claim 2 wherein said oxygen-free gas is passed downwardly through said stationary batch of oil shale.

4. The method as set forth in claim 1 wherein said material heating step also includes the steps of preheating said oil shale prior to placement thereof in said system, initially heating atmospheric air as said gas and removing substantially all of the oxygen therefrom, cyclically passing the resulting substantially oxygen-free gases through said oil shale.

5. The method as set forth in claim 1 wherein steam is injected at or near the conclusion of said initial heating step, and during passage of said vaporized hydrocarbons out of said system.

6. The method as set forth in claim 1 wherein said recovery stage includes condensing means, and said recovery step includes the steps of passing said vaporized hydrocarbons through said condensing means for condensing a portion of the latter.

7. The method as set forth in claim 6 including the step of collecting the noncondensible hydrocarbons remaining after said condensation step.

8. The method as set forth in claim 1 wherein said pressure is allowed to build up to a level of no more than about 15 p.s.i.g. during said initial heating step.

9. The method as set forth in claim 1 wherein said pressure is relieved until the pressure within said system is essentially atmospheric.

* * * * *